US008119958B2

(12) United States Patent
Adams et al.

(10) Patent No.: US 8,119,958 B2
(45) Date of Patent: Feb. 21, 2012

(54) METHOD AND DEVICE FOR MATRIX OF EXPLOSIVE CELLS

(75) Inventors: Christian Adams, Yalaha, FL (US); Kenneth S. Gurley, Windermere, FL (US); Tara Y. Rohter, Orlando, FL (US); Patrick A. Nelson, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 260 days.

(21) Appl. No.: 12/389,271

(22) Filed: Feb. 19, 2009

(65) Prior Publication Data

US 2012/0012690 A1 Jan. 19, 2012

(51) Int. Cl.
*F42B 15/01* (2006.01)
*H01H 37/76* (2006.01)
*F42B 15/00* (2006.01)

(52) U.S. Cl. ..... 244/3.21; 244/3.1; 244/3.11; 244/3.14; 244/3.15; 89/1.11; 89/1.1; 327/524; 327/525; 102/301; 102/305; 102/311; 102/501

(58) Field of Classification Search ..... 244/3.1, 244/3.15–3.22, 1 R, 3.11–3.14; 89/1.11, 89/1.1; 102/305–310, 475, 476, 301, 311, 102/363, 401, 402, 403, 405, 406, 409, 410, 102/416, 424–427, 501; 342/59, 61–67, 342/175, 195; 367/14, 37, 38, 56, 57, 119, 367/197; 405/195.1, 211; 114/382, 240 R, 114/241, 240 C, 240 E; 327/524, 525; 181/106, 181/107, 111, 113, 116
See application file for complete search history.

(56) References Cited

U.S. PATENT DOCUMENTS

| | | | | | |
|---|---|---|---|---|---|
| 1,337,920 | A | * | 4/1920 | Kohler | 89/1.11 |
| 3,016,831 | A | * | 1/1962 | Coursen | 102/305 |
| 3,741,119 | A | * | 6/1973 | Eckels | 102/310 |
| 4,043,266 | A | * | 8/1977 | Held | 102/306 |
| 4,051,763 | A | * | 10/1977 | Thomanek | 102/310 |
| 4,317,414 | A | * | 3/1982 | Grawe et al. | 102/406 |
| 4,359,944 | A | * | 11/1982 | Stiennon | 102/405 |
| 4,768,417 | A | * | 9/1988 | Wright | 89/1.11 |
| 4,899,956 | A | | 2/1990 | King et al. | |
| 4,951,901 | A | | 8/1990 | Dunne | |
| 5,139,216 | A | | 8/1992 | Larkin | |
| 5,379,968 | A | | 1/1995 | Grosso | |

(Continued)

FOREIGN PATENT DOCUMENTS

WO WO87/04146 A1 * 7/1987

*Primary Examiner* — Bernarr Gregory
(74) *Attorney, Agent, or Firm* — Buchanan Ingersoll & Rooney PC

(57) ABSTRACT

A matrix of explosive cells can include plural explosive cells formed in an array in a common substrate. Each cell can be formed as a recess filled with explosive material. An ignition device has an addressable ignition source for each cell. This matrix can be used in combination with a projectile guidance system. The projectile guidance system includes an antenna, a transceiver and a control processor. A method of guiding a projectile can include firing a projectile at a target, tracking the projectile and the target, determining a desired change in a flight path of the projectile, transmitting guidance commands to effect the desired change in the projectile's flight path to the projectile, receiving the guidance commands onboard the projectile and selectively igniting an explosive cell in a matrix of addressable explosive cells contained in a common substrate using the guidance commands.

23 Claims, 3 Drawing Sheets

U.S. PATENT DOCUMENTS 5,388,521 A * 2/1995 Coursen ..... 102/311
5,583,311 A * 12/1996 Rieger ..... 89/1.11
5,685,504 A 11/1997 Schneider et al.
5,724,311 A * 3/1998 Laurent et al. ..... 367/57
5,788,178 A 8/1998 Barrett, Jr.
5,788,180 A 8/1998 Sallee et al.
6,014,932 A * 1/2000 Mardirossian ..... 89/1.11
6,076,765 A 6/2000 Horwath
6,182,553 B1 * 2/2001 Peterson ..... 89/1.11
6,325,015 B1 * 12/2001 Garcia et al. ..... 114/382
6,357,695 B1 3/2002 Horwath
6,422,507 B1 7/2002 Lipeles
6,474,593 B1 11/2002 Lipeles et al.
6,591,774 B2 * 7/2003 Metherell et al. ..... 114/241
6,612,244 B1 * 9/2003 Grosch et al. ..... 102/402
6,626,077 B1 * 9/2003 Gilbert ..... 89/1.11
6,766,979 B2 7/2004 Horwath
6,806,823 B1 10/2004 Smith et al.
6,817,569 B1 11/2004 Horwath
6,904,838 B1 * 6/2005 Dindl ..... 89/1.1
7,036,767 B2 5/2006 Chishinski
7,744,313 B2 * 6/2010 Terai et al. ..... 114/241
2004/0149156 A1 * 8/2004 Yi et al. ..... 102/363
2005/0039626 A1 * 2/2005 Yi et al. ..... 102/363
2007/0023567 A1 2/2007 Lindquist et al.

* cited by examiner

METHOD AND DEVICE FOR MATRIX OF EXPLOSIVE CELLS

BACKGROUND

1. Field

A matrix of explosive cells is disclosed that can be reduced in size and that can provide individual bursts of energy. Such a matrix can be used for projectile guidance of, for example, small, fast-moving projectiles, such as bullets and small artillery rounds. Such a matrix can also be used in security systems to, for example, provide targeted destruction of discrete sections.

2. Description of Related Art

Known projectile guidance systems, such as those disclosed in U.S. Pat. Nos. 6,422,507 and 6,474,593, use microelectromechanical systems (MEMS) gyros, MEMS actuators and the selective extension of flight control devices, such as spoilers or flaps.

SUMMARY

In an exemplary embodiment, a matrix of explosive cells comprises plural explosive cells formed in an array in a common substrate, each cell being formed as a recess filled with explosive material and an ignition device containing an addressable ignition source for each cell.

In another exemplary embodiment, the abovementioned matrix can be combined with a projectile guidance system for guiding a projectile. The system can include an antenna; a transceiver operatively connected with the antenna and a control processor operatively connected with the transceiver and the matrix.

In another exemplary embodiment, a method of guiding a projectile can comprise firing a projectile at a target; tracking the projectile and the target; determining a desired change in a flight path of the projectile; transmitting guidance commands to effect the desired change in the projectile's flight path to the projectile; receiving the guidance commands onboard the projectile and selectively igniting an explosive cell in a matrix of addressable explosive cells contained in a common substrate using the guidance commands.

In another exemplary embodiment, a security system can comprise an antenna; a receiver or transceiver operatively connected with the antenna; a control processor operatively connected with the receiver or transceiver; and a matrix of explosive cells incorporated into a component and operatively connected with the control processor, wherein the matrix of explosive cells can be activated in response to a triggering event.

BRIEF DESCRIPTION OF THE DRAWINGS

Those skilled in the art will realize that different embodiments are possible, and the details disclosed herein are capable of modification in various respects, all without departing from the scope of the claims. Accordingly, the drawings and descriptions are to be regarded as illustrative in nature and not as restrictive. Like reference numerals have been used to designate like elements.

DETAILED DESCRIPTION

Figure 1:
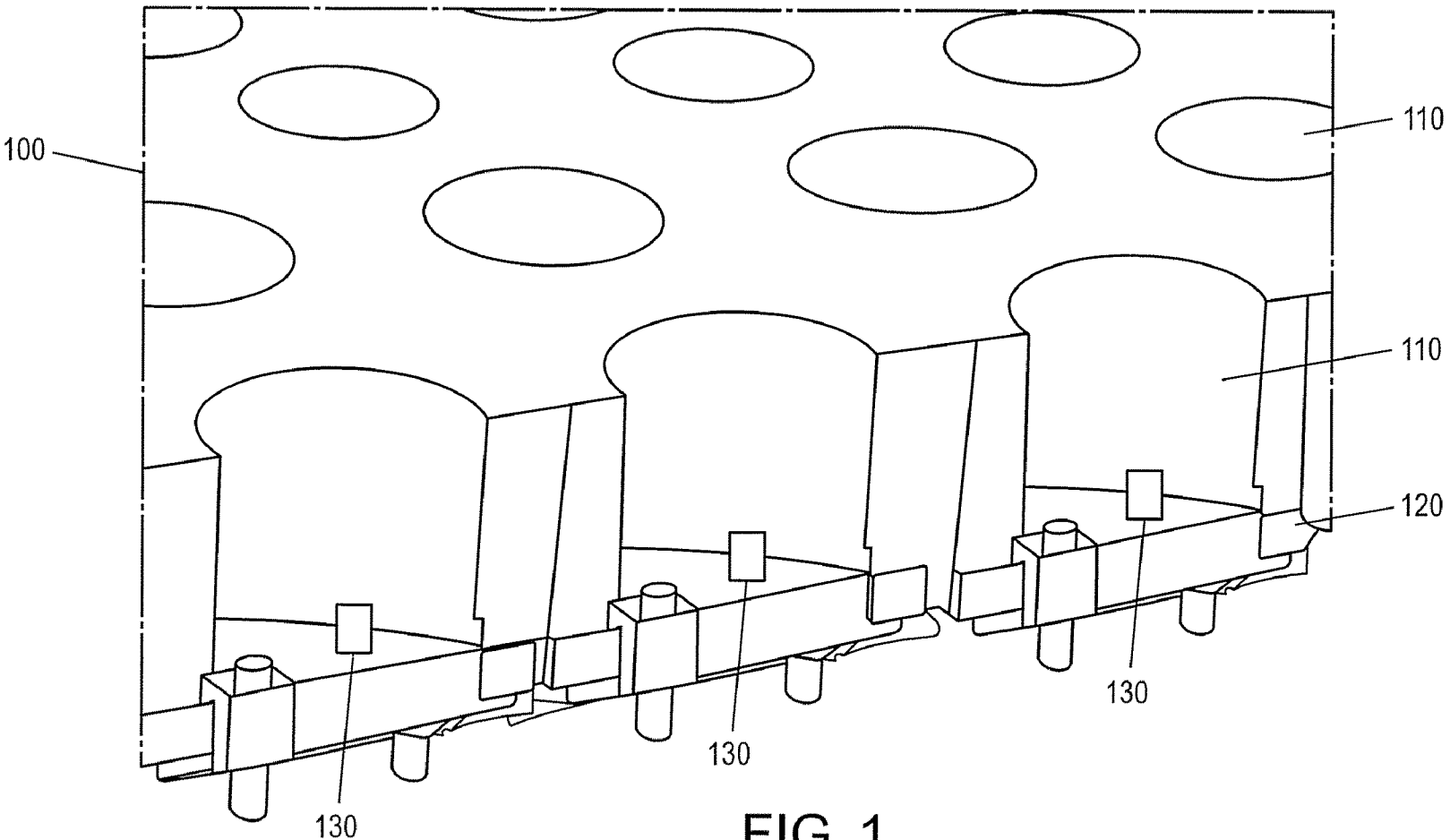
FIG. 1 shows an exemplary embodiment of a matrix of explosive cells.

FIG. 1 shows a magnified exemplary embodiment of a matrix 100 of explosive cells 110 that can include plural explosive cells 110 formed in an array in a common substrate 120. Each cell 110 can be formed as a recess filled with explosive material. An ignition device or source 130 can contain an addressable ignition source for each cell.

Figure 2:
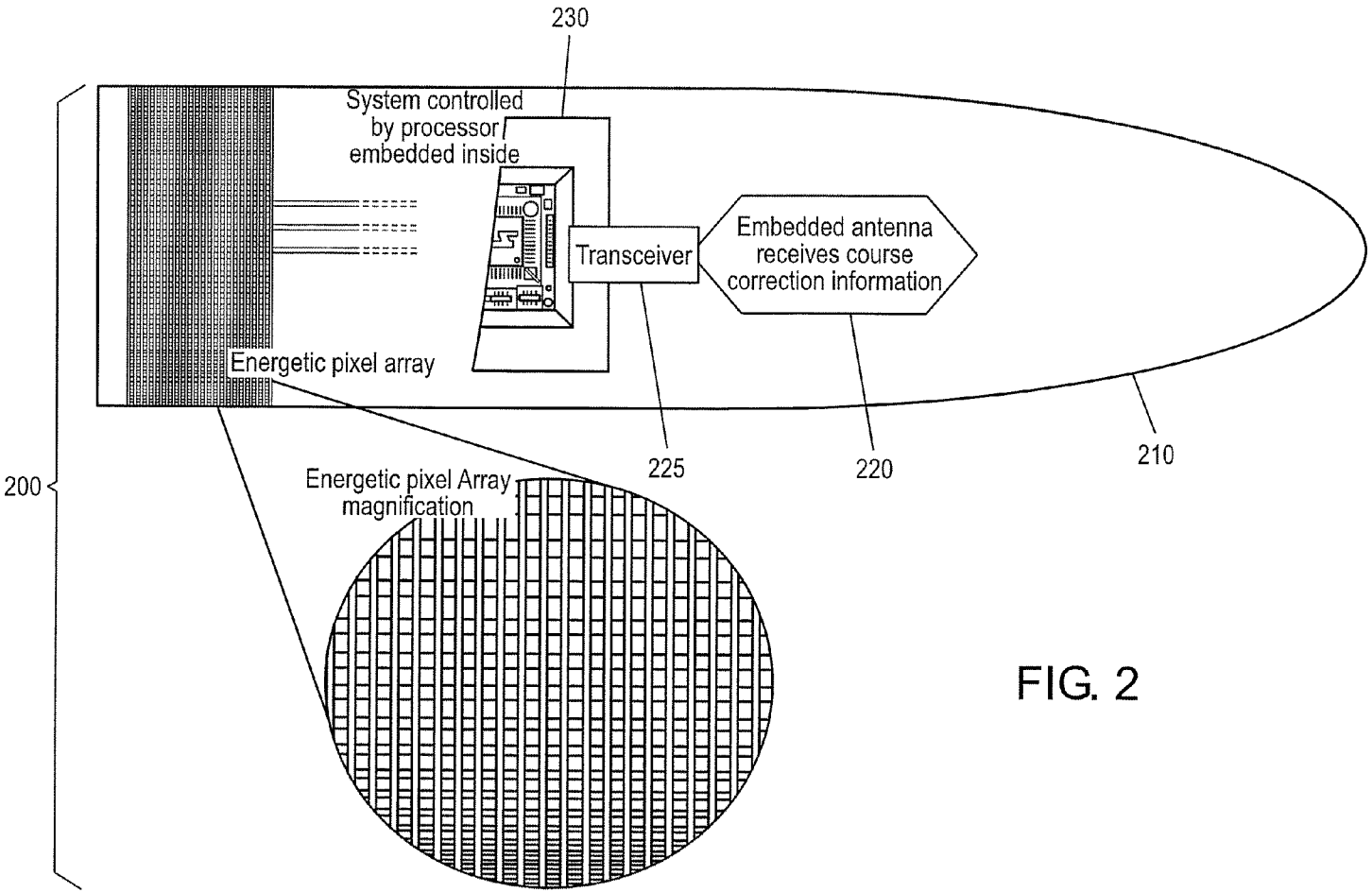
FIG. 2 shows an exemplary embodiment of a matrix of explosive cells in combination with a projectile guidance system.

FIG. 2 shows an exemplary embodiment of the matrix 200 shown in FIG. 1 in combination with a projectile guidance system for guiding a projectile 210. The system can include an antenna 220, a transceiver 225 operatively connected with the antenna 220 and a control processor 230 operatively connected with the transceiver 225 and the matrix 200.

In an embodiment, the projectile 210 can be a .50 caliber round, for example. In other embodiments, the projectile 210 could include other sizes of bullets and small artillery rounds. Larger ammunition types could also be accommodated by this technology but may be more easily accommodated by known guidance assist mechanisms. A lower limit for this technology application can be based on the extent to which the technology can be miniaturized. In an embodiment, the projectile 210 can be free to spin like known projectiles shot from rifled barrels, for example.

In an embodiment, the antenna 220 can be configured for radio frequency (RF), infrared (IR) or other optical frequencies, or other electromagnetic frequencies. The antenna 220 can be operatively connected with transceiver 225 that can enable information about the projectile 210, e.g., spin rate, accelerometer data, etc., to be exchanged with control processor 230, such as a guidance control computer, that can be embedded internal to the projectile 210. The positional information from the projectile 210 can in turn be transmitted to an external monitoring and control entity (not shown).

Depending on the technology used for communication, an antenna 220 (in the case of RF) or corresponding window of suitable material (in the case of IR or other optical) can be provided so that communication between the projectile 210 and an external monitoring and control entity can take place. This communication can be accomplished using encrypted communications, depending on the security needs of the operational environment.

An external monitoring and control entity, e.g., a "spotter," that could include an entity that originally fired the round, or perhaps a third party or system, can keep track of a target at which the projectile 210 is fired, and by virtue of information provided by the guidance system, can monitor and control the trajectory of the projectile 210. The external control entity, through the use of associated known transmitting/receiving equipment configured for the projectile's 210 communications technology (e.g., RF, IR, optical, etc.), can communicate with the projectile 210. Thus, communications and flight path correction commands can take place in real-time.

In an embodiment, an RF transceiver 225 can be part of an overall monolithic single-chip design that also includes the control processor 230. Other on-chip features can include MEMS-type devices, such as an accelerometer and/or GPS and/or additional sensor technology. Similar features can also be used with an IR transceiver.

In an embodiment, the control processor 230, which may be configured as a guidance computer, for example, can also be part of an overall monolithic single-chip design that includes the transceiver 225 as described above. An embodiment can also include a MEMS-based power supply for energy-scavenging/power generation that can take advantage of a high rotation rate of the projectile 210 and initial shock/vibration energy, whereby mechanical energy of the projectile 210 can be converted to electrical energy to power the control processor 230, for example.

Referring again to FIG. 1, in an embodiment, microscopic explosive, e.g., thermite, cells 110 formed in an array in a common substrate 120 can be formed as recesses filled with explosive material within a macroscopic array and may be ignited as needed to control the course of, e.g., projectile 210 in FIG. 2. In an embodiment, thin-film thermite may be organized into cells 110 that are quiescent until called upon for performing course correction of the projectile 210. Thus, in an embodiment, the energy involved for course correction can be stored as potential chemical energy in the form of the thermite material.

In an embodiment, the matrix 100 of explosive cells 110 can be manufactured by fashioning recesses into a ceramic substrate 120 via laser milling. For example, the recesses may have a diameter of approximately 200 μm. In an embodiment, a sufficient quantity, e.g., approximately 2 g of thermite comprising a CuO/Al mixture may be crushed into powder and packed into an array of such laser-drilled cells 110. In an embodiment, a layer (not shown) may be placed over the recesses to protect and contain the thermite. With the proper substrate 120, and with suitable masking, fixturing and equipment, thermite can be applied via thin-film deposition processes, for example. In an embodiment, the exemplary thermite-filled cells 110 can provide approximately 0.11 J/cell of thrust.

The layer that can be placed over the recesses to protect and contain the thermite may, for example, be made of relatively inert material, such as a thin $SiO_2$ overlayer, and is preferably capable of thermally protecting the explosive material below it from adjacent cells 110 being set off. Such a layer could be sputter coated onto the surface of the thermite. Preferably, this layer would not crack off from thermal variances in various parts of the active surface.

Alternatives to thermite can also be used. Theoretically, any energetic substance with similar properties could work. Characteristics of a suitable material can include, for example, high-energy-density, high-stability, a capability of producing high-speed reaction products, and facile material application and/or deposition. Different substances can involve different approaches to a hog-out size, i.e., they may need recesses larger or smaller than 200 μm. In addition, non-thermite energetic alternatives can involve an "explosive train," i.e., a succession of initiating and igniting elements arranged to cause a charge to function in addition to a single compact semiconductor bridge igniter, which will be described in more detail later.

The parameters affecting substrate 120 size/position/density can be part of individualizing the technology to the platform in question, i.e. the specific projectile size, etc. The composition of the cell matrix 100 can be tailored to the mass of the bullet/projectile, spin rate, velocity and desired control over the trajectory, for example.

In an embodiment, placing the matrix 100 of explosive cells 110 at the rear of the bullet/projectile 210 relative to the direction of flight can have a meaningful impact on trajectory of the projectile 210. The placement of matrix 100 of explosive cells 110, however, can also vary with bullet/projectile 210 mass distribution, size, normal target space, speed, spin-rate, etc. Placement of the matrix 100 of explosive cells 110 within the design constraints of the projectile 210 packaging can be such that the enhancements are fully transparent to existing hardware designs, such as gun barrels and basic firing mechanisms, e.g., firing pins, strikers, etc.

In an embodiment, a conventional (unmodified) .50 caliber machine gun and a projectile 210 equipped with matrix 100 of explosive cells 110 could be used in conjunction with the assistance of an external guidance and control system, for example. That is, the projectile 210 and the external control mechanism(s), and not the gun barrel, for example, would require modifications. Backwards compatibility can also be achieved with other conventional projectile delivery systems.

In an embodiment, a semiconductor bridge can be used, for example, as an ignition source 130 at the base of each cell 110 to initiate the ignition of each cell 110. Semiconductor bridge (SCB) initiators are known fast-acting, low-energy electro-explosive devices. SCB initiators can be extremely efficient at converting electrical energy to explosive energy to produce a squib or detonation output. In an embodiment, an ignition source 130 can be on the order of less than one millijoule to several millijoules.

A component of an SCB initiator is the semiconductor bridge chip itself. By controlling the size and shape of the bridge area on the chip, the firing characteristics of the initiator can be controlled. Since SCB chips can be built using standard semiconductor processing techniques, additional "on-chip" electrical circuitry can be added to a number of designs. A variety of SCB initiators have been developed to meet specific requirements, such as immunity to electrostatic discharge (ESD), voltage blocking for Radio Frequency (RF) protection and very low initiation energy applications. With an SCB, each explosive cell 110 can be logically addressable, e.g., as is each pixel in an LCD display, such that the initiation of each SCB, and hence each associated explosive cell 110, can be controlled by the control processor 230.

Examples of known SCBs include those manufactured by Ensign-Bickford Aerospace & Defense Company of Simsbury, Conn. Exemplary semiconductor bridge sizes can range from, for example, 15 μm×36 μm to 90 μm to 270 μm.

The control processor 230, transceiver 225 and the SCBs can receive power from a power supply, such as a battery (not shown). In an embodiment, a thin-film thermal battery can provide power for the duration of the projectile's 210 flight. Known thin-film thermal batteries can be more compact than their more conventional battery counterparts. The diminutive size of thin-film batteries can make it practical to incorporate such batteries into microelectronic packages and use them to power an exemplary explosive cell array system as disclosed herein.

In an exemplary method of operation, projectile 210 can be fired by a stock .50 caliber gun (not shown). A separate external monitoring and guidance control unit (not shown) can be equipped with a sight, for example, that can track both the projectile 210 and a target simultaneously using known systems and techniques, such as optical or radar tracking. The external monitoring and guidance control unit can monitor the trajectory of the projectile 210 and the target and determine any error or change in the flight path of the projectile necessitating a desired control maneuver. The external monitoring and guidance control unit can transmit an appropriate control signal to the projectile via RF or IR signals, for example.

Within the projectile 210, the control signals can be received by the antenna 220 and transceiver 225. Interpreted commands can be generated by control processor 230 whereby the logical addresses of the individual explosive cells 110 needed for course correction can be calculated. Once the logical addresses are determined for a given course correction to occur, the control processor 230 can send a power signal to an SCB 130 located at the base of the cell(s) 110, whereupon the cell 110 is ignited, a material conversion shockwave is started, energy is discharged in a vector normal to the circumference of the projectile 210 and the course correction is made.

In an embodiment, the course of the projectile 210 can be monitored and course corrections can be made until all of the explosive cells 110 are consumed. In an embodiment, multiple less-than-optimal explosive cells 110 can be selected by the control processor 230 and fired in the place of one optimum cell 110 if that cell has already been fired. If there are any unconsumed cells left immediately prior to impact, a signal can be sent to the projectile 210 that can cause the remaining explosive cells to fire simultaneously (within the constraints mentioned below), thereby increasing the energy of the impact with the added chemical energy from the cells.

The material(s) making up both the space between cells 110 and the inert overlayer can be formulated such that a simultaneous firing of approximately four adjacent cells (in an embodiment, purposely not normally allowed in the logical solution sets of possible course corrections) causes a chain reaction and all remaining cells can be ignited with the help of an additional ignition signal. This can be accomplished through proper selection of materials that promote insensitivity within a certain temperature range, i.e., the logically defined constraint of <4 adjacent cells being fired at any given time is an example that could preserve the cell framework. The framework itself, and not the inert overlayer, can be formulated of a material, i.e., a different kind of thermite with higher activation energy, that has an ignition point that can be reached when the ≧4-cell ignition scenario is reached. Once this condition is met, then the thermitic chain reaction can occur as the remaining cell framework is consumed, within the geometric limits of the remaining material An exemplary explosive cell array system, similar to the embodiment discussed above, can be used for any application desiring a simple, quickly initiated, and energetic solution where extremely small quantities of "propellant" effect changes in an object's course via direct momentum transfer and manipulation of high velocity air flow to create highly-dynamic and controllable vehicle drag for steering purposes, such as, for example, bullets and artillery rounds.

Exemplary embodiments of an explosive cell array system can also be used for any application desiring the simultaneous ignition of all explosive cells, for example, in a security system designed to carry out the targeted destruction of a discrete section of, for example, a circuit board. Electronic systems can incorporate valuable structures, software code, data and intellectual property. These valuable items can be targets of espionage from competitors, foreign governments and other potential adversaries. An unauthorized entity could attempt to gain possession of such systems and then use reverse engineering methods to extract as much valuable technology as possible. Consequently, protective technologies can be incorporated into, for example, electronic systems to frustrate these types of inquisitive activities.

For example, the explosive cell array system described above can be used as a "blanket of destruction" when inserted as an appliqué on top of circuitry that requires controlled destruction.

Figure 3:
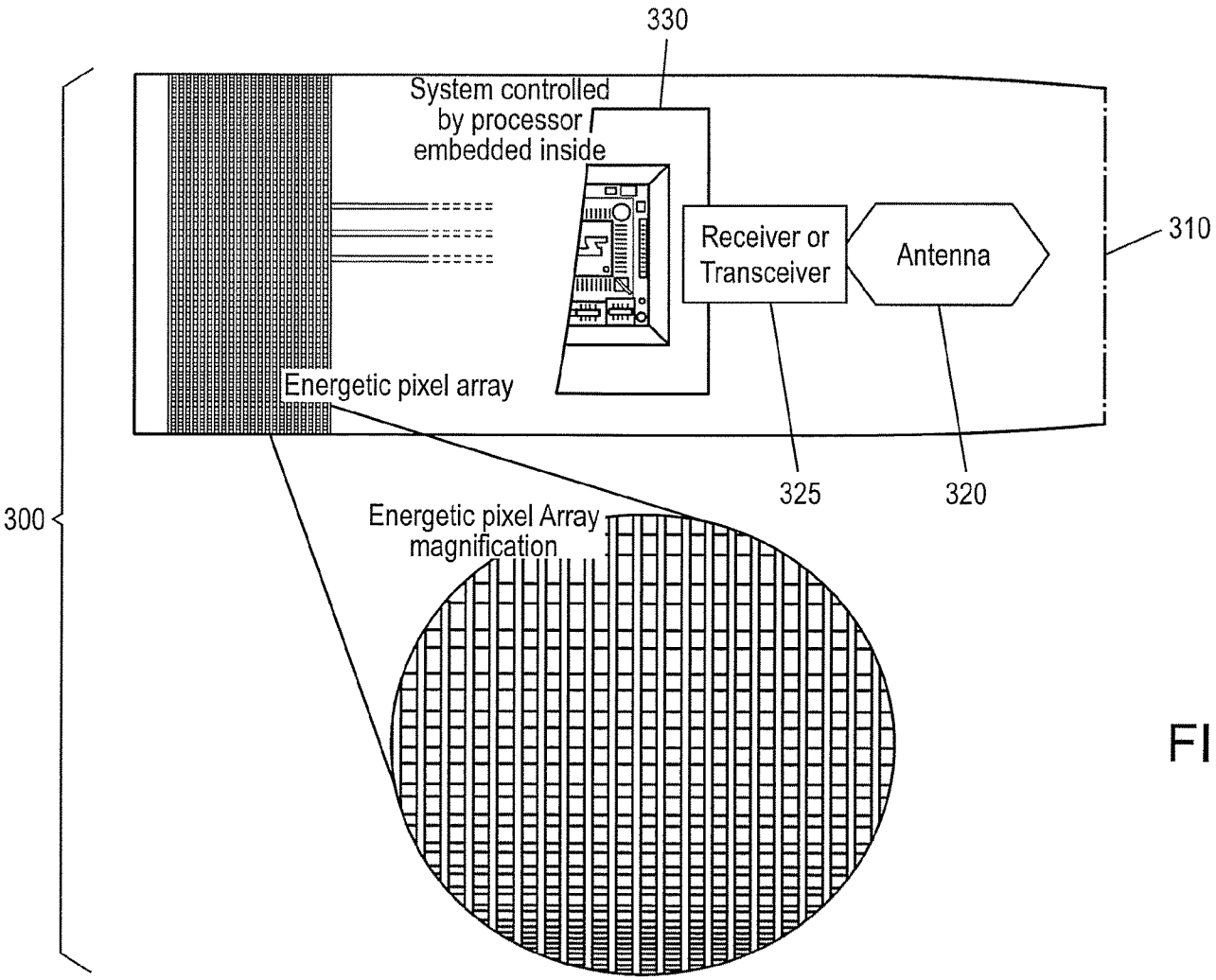
FIG. 3 shows an exemplary embodiment of a matrix of explosive cells in combination with a security system.

In an embodiment shown in FIG. 3, similar to the projectile guidance system shown in FIG. 2, a security system can include an antenna 320, a receiver or transceiver 325 operatively connected with the antenna 320, a control processor 330 operatively connected with the receiver or transceiver 325 and an explosive cell array 300 incorporated into an electronic component 310, for example, and operatively connected with the control processor 330. The explosive cell array 300 can be activated in response to a triggering event by exemplary methods that will be explained below.

An explosive cell array 300 can be positioned in contact with or near components, such as circuit boards or other electronic components for which a remotely controlled targeted destruction capability is desired through the simultaneous ignition of all or less than all explosive cells. In such embodiments, the explosive cell array 300 can be placed in physical proximity to the structures and/or data to be thermally damaged or destroyed so as to facilitate rapid thermal transfer upon activation. Similar to the projectile guidance embodiments, an external control entity, through the use of associated transmitting equipment specific to the transmission technology (e.g., IR, RF, etc.), can communicate a triggering event to the explosive cell array 300, i.e., remotely control the array, via the antenna 320, receiver or transceiver 325 and control processor 330, to initiate activation of the explosive cell array 300.

A destruction initiation signal can be sent to an explosive cell array through the use of internal or external/proximity security devices configured to detect tampering to a piece of equipment and send a triggering event to the control processor. Non-limiting examples of such security devices can include motion sensors or switches that can complete or open a circuit to send a signal when a component enclosure is opened or shut because of tampering with a piece of equipment, for example. Other known sensors can be used and can include piezoelectrically sensitive sensors where the sensor output is an electrical signal sent to the control processor, for example.

The above description is presented to enable a person skilled in the art to make and use the systems and methods described herein, and is provided in the context of a particular application and its requirements. Various modifications to the embodiments will be readily apparent to those skilled in the art, and the generic principles defined herein may be applied to other embodiments and applications without departing from the spirit and scope of the claims. Thus, there is no intention to be limited to the embodiments shown, but rather to be accorded the widest scope consistent with the principles and features disclosed herein.

What is claimed is:

1. A matrix of explosive cells, comprising:

plural explosive cells formed in an array in a common substrate, each cell being formed as a recess filled with explosive material; and an ignition device containing an addressable ignition source for each cell.

2. The matrix of claim 1, in combination with a projectile guidance system for guiding a projectile, comprising:

an antenna;

a transceiver operatively connected with the antenna; and a control processor operatively connected with the transceiver and the matrix.

3. The system of claim 2, comprising:

an external control means configured to communicate with the control processor.

4. The system of claim 3, wherein the external control means and control processor are configured to communicate using encrypted communications.

5. The system of claim 2, wherein the projectile is at least one of a bullet and an artillery round.

6. The system of claim 2, wherein the antenna is at least one of a radio frequency antenna and infrared antenna.

7. The system of claim 2, wherein the matrix is located on a portion of the projectile suitable for controlling a direction of flight of the projectile.

8. The matrix of claim 1, wherein the explosive material comprises thermite.

9. The matrix of claim 1, wherein the matrix comprises an $SiO_2$ layer configured to protect and contain material therein.

10. The matrix of claim 1, wherein the ignition source is a semiconductor bridge.

11. The matrix of claim 10, comprising:

a power supply configured to provide power to the semiconductor bridge, wherein the power supply is at least one of a thin-film thermal battery and a MEMS-based power supply device.

12. A method of guiding a projectile, comprising:

firing a projectile at a target;

tracking the projectile and the target;

determining a desired change in a flight path of the projectile;

transmitting guidance commands to effect the desired change in the projectile's flight path to the projectile;

receiving the guidance commands onboard the projectile; and selectively igniting an explosive cell in a matrix of addressable explosive cells contained in a common substrate using the guidance commands.

13. The method of claim 12, comprising:

igniting unused explosive cells upon determination that the projectile is about to impact the target.

14. A security system for a component to be damaged or destroyed, comprising:

an antenna;

a receiver operatively connected with the antenna;

a control processor operatively connected with the receiver; and a matrix of explosive cells incorporated into the component and operatively connected with the control processor for being activated in response to a triggering event.

15. The system of claim 14, wherein the triggering event is indicative of a breach of security with respect to the component.

16. The system of claim 14, wherein the triggering event is provided by an external control means configured to communicate with the control processor.

17. The system of claim 14, wherein the triggering event is provided by an internal control means configured to communicate with the control processor.

18. The system of claim 14, wherein the antenna is at least one of a radio frequency antenna and infrared receiver.

19. The system of claim 14, wherein the matrix of explosive cells comprises thermite-filled recesses.

20. The system of claim 14, wherein the matrix of explosive cells comprises an $SiO_2$ layer configured to protect and contain material therein.

21. The system of claim 14, comprising:

a semiconductor bridge operatively connected to each explosive cell in the matrix of explosive cells and configured to receive an initiation signal from the control processor.

22. The system of claim 21, comprising:

a power supply configured to provide power to at least one of the control processor, transceiver and semiconductor bridge, wherein the power supply is at least one of a thin-film thermal battery and a MEMS-based power supply device.

23. A method of providing security for a component to be damaged or destroyed, comprising:

incorporating a matrix of explosive cells into the component;

determining whether to initiate destruction of the component by use of the matrix of explosive cells, and in the event a determination is made to initiate destruction of the component, transmitting a destruction initiation command to a control processor operatively connected with the matrix of explosive cells;

processing the transmitted destruction initiation command in the control processor; and selectively igniting one or more explosive cells in the matrix of explosive cells in accordance with the processed destruction command.

* * * * *